US011499786B2

(12) United States Patent
Blomgren

(10) Patent No.: US 11,499,786 B2
(45) Date of Patent: Nov. 15, 2022

(54) HEAT TRANSFER PLATE

(71) Applicant: ALFA LAVAL CORPORATE AB, Lund (SE)

(72) Inventor: Fredrik Blomgren, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 17/290,442

(22) PCT Filed: Nov. 11, 2019

(86) PCT No.: PCT/EP2019/080830
§ 371 (c)(1),
(2) Date: Apr. 30, 2021

(87) PCT Pub. No.: WO2020/108969
PCT Pub. Date: Jun. 4, 2020

(65) Prior Publication Data

US 2021/0310744 A1 Oct. 7, 2021

(30) Foreign Application Priority Data

Nov. 26, 2018 (EP) ..... 18208338

(51) Int. Cl.
*F28D 9/00* (2006.01)
*F28F 3/04* (2006.01)
*F28F 13/12* (2006.01)

(52) U.S. Cl.
CPC ..... *F28D 9/0037* (2013.01); *F28D 9/005* (2013.01); *F28F 3/04* (2013.01); *F28F 13/12* (2013.01); *F28F 2250/10* (2013.01)

(58) Field of Classification Search
CPC ..... F28D 9/0037; F28D 9/005; F28D 9/00; F28D 9/0012; F28D 9/0031; F28F 3/04;
(Continued)

(56) References Cited

U.S. PATENT DOCUMENTS 4,781,248 A 11/1988 Pfeiffer
7,168,483 B2 1/2007 Blomgren et al.
(Continued)

FOREIGN PATENT DOCUMENTS

CN 101158561 A 4/2008
CN 101636630 A 1/2010
(Continued)

OTHER PUBLICATIONS

International Search Report (PCT/ISA/210) and Written Opinion (PCT/ISA/237) dated Mar. 13, 2020, by the European Patent Office as the International Searching Authority for International Application No. PCT/EP2019/080830. (10 pages).
(Continued)

*Primary Examiner* — Harry E Arant
(74) *Attorney, Agent, or Firm* — Buchanan Ingersoll & Rooney PC

(57) ABSTRACT

A heat transfer plate comprises a first end portion, a second end portion and a center portion arranged in succession along a longitudinal center axis of the plate. The center portion comprises a heat transfer area provided with a heat transfer pattern comprising support ridges and support valleys longitudinally extending parallel to the longitudinal center axis of the plate. The support ridges and support valleys are alternately arranged along a number of separated imaginary longitudinal straight lines extending parallel to the longitudinal center axis of the plate and along a number of separated imaginary transverse straight lines extending perpendicular to the longitudinal center axis of the plate. The heat transfer pattern further comprises turbulence ridges and turbulence valleys. At least a plurality of the turbulence ridges and turbulence valleys along at least a center portion of their longitudinal extension extend inclined relative to the transverse imaginary straight lines.

17 Claims, 5 Drawing Sheets

(58) Field of Classification Search
CPC ..... F28F 13/12; F28F 2250/10; F28F 3/046; F28F 13/06; F28F 13/3025
See application file for complete search history.

(56) References Cited

U.S. PATENT DOCUMENTS

| | | | | |
|---|---|---|---|---|
| 9,518,782 | B2 | 12/2016 | Blomgren et al. | |
| 2004/0069473 | A1* | 4/2004 | Blomgren | F28F 3/04 165/167 |
| 2015/0276319 | A1 | 10/2015 | Hedberg et al. | |
| 2015/0278819 | A1 | 10/2015 | Song et al. | |
| 2017/0067695 | A1 | 3/2017 | Wei et al. | |
| 2017/0102193 | A1* | 4/2017 | Atkinson | F28F 3/025 |
| 2017/0254596 | A1 | 9/2017 | Noel-baron | |

FOREIGN PATENT DOCUMENTS

| | | | |
|---|---|---|---|
| CN | 101782345 | A | 7/2010 |
| CN | 201583181 | U | 9/2010 |
| CN | 202133321 | U | 2/2012 |
| CN | 202582326 | U | 12/2012 |
| CN | 102997742 | A | 3/2013 |
| CN | 107076520 | A | 8/2017 |
| CN | 207590547 | U | 7/2018 |
| CN | 108885074 | A | 11/2018 |
| EA | 005643 | B1 | 4/2005 |
| EP | 0 636 239 | B1 | 12/1999 |
| EP | 2 778 775 | A1 | 9/2014 |
| EP | 2988085 | A1 | 2/2016 |
| EP | 2776775 | B1 | 8/2016 |
| EP | 3 101 376 | A1 | 12/2016 |
| GB | 1197963 | A | 7/1970 |
| JP | 2002130977 | A | 5/2002 |
| JP | 2002-180977 | A | 6/2002 |
| JP | 2014-532852 | A | 12/2014 |
| JP | 2017-504780 | A | 2/2017 |
| JP | 2018-179340 | A | 11/2018 |
| KR | 20-0437768 | Y1 | 12/2007 |
| SU | 462355 | A3 | 2/1975 |
| WO | 94/19657 | A1 | 9/1994 |
| WO | 02/051538 | A1 | 7/2002 |
| WO | 2008/055981 | A1 | 5/2008 |
| WO | 2008113740 | A1 | 9/2008 |
| WO | 2008/118740 | A2 | 10/2008 |
| WO | 2013070530 | A1 | 5/2013 |
| WO | 2015/113468 | A1 | 8/2015 |
| WO | 2017/167598 | A1 | 10/2017 |
| WO | 2018/133954 | A1 | 7/2018 |

OTHER PUBLICATIONS

"Alfa Laval WideGap-heat exchangers for fluids containing solids or fibres", Mind the Gap brochure, PFL00039EN, 1505, exact publication date unknown, but at least as early as Nov. 26, 2018, (6 pages).

English Translation of the Office Action (Notice of Preliminary Rejection) dated Aug. 5, 2021, by the Korean Intellectual Property Office in corresponding Korean Patent Application No. 10-2021-7019426. (3 pages).

"Alfa Laval WideGap-heat exchangers for fluids containing solids or fibres", Mind the Gap brochure, PFL00039EN, 1505. (6 pages).

English Translation of the Office Action (Decision to Grant) dated Sep. 1, 2021, by the Federal Service for Intellectual Property (ROSPATENT) in corresponding Russian Patent Application No. 2021118261/(038417). (9 pages).

Notice of Allowance dated Oct. 18, 2021, by the Japanese Patent Office in corresponding Japanese Patent Application No. 2021-529454. (3 pages).

Office Action dated Dec. 14, 2021, by the Brazil Patent Office in corresponding Brazil Patent Application No. BR112021006971-2. (6 pages).

Office Action (The First Office Action) dated Aug. 26, 2021, by the State Intellectual Property Office of People's Republic of China in corresponding Chinese Patent Application No. 201980077620.6 and an English Translation of the Office Action. (10 pages).

* cited by examiner

HEAT TRANSFER PLATE

TECHNICAL FIELD

The invention relates to a heat transfer plate and its design.

BACKGROUND ART

Plate heat exchangers, PHEs, typically consist of two end plates in between which a number of heat transfer plates are arranged aligned in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other. In still other PHEs, the heat transfer plates are stacked with the front side and the back side of one heat transfer plate facing the front side and back side, respectively, of other heat transfer plates, without every other heat transfer plate being turned upside down in relation to the rest of the heat transfer plates. This may be referred to as the heat transfer plates being "turned" in relation to each other.

In one type of well-known PHEs, the so called gasketed PHEs, gaskets are arranged between the heat transfer plates. The end plates, and therefore the heat transfer plates, are pressed towards each other by some kind of tightening means, whereby the gaskets seal between the heat transfer plates. Parallel flow channels are formed between the heat transfer plates, one channel between each pair of adjacent heat transfer plates. Two fluids of initially different temperatures, which are fed to/from the PHE through inlets/outlets, can flow alternately through every second channel for transferring heat from one fluid to the other, which fluids enter/exit the channels through inlet/outlet port holes in the heat transfer plates communicating with the inlets/outlets of the PHE.

Typically, a heat transfer plate comprises two end portions and an intermediate heat transfer portion. The end portions comprise the inlet and outlet port holes and distribution areas pressed with a distribution pattern of ridges and valleys. Similarly, the heat transfer portion comprises a heat transfer area pressed with a heat transfer pattern of ridges and valleys. The ridges and valleys of the distribution and heat transfer patterns of the heat transfer plate is arranged to contact, in contact areas, the ridges and valleys of distribution and heat transfer patterns of adjacent heat transfer plates in a plate heat exchanger. The main task of the distribution areas of the heat transfer plates is to spread a fluid entering the channel across the width of the heat transfer plates before the fluid reaches the heat transfer areas, and to collect the fluid and guide it out of the channel after it has passed the heat transfer areas. On the contrary, the main task of the heat transfer area is heat transfer.

Since the distribution areas and the heat transfer area have different main tasks, the distribution pattern normally differs from the heat transfer pattern. The distribution pattern may be such that it offers a relatively weak flow resistance and low pressure drop which is typically associated with a more "open" distribution pattern design, such as a so-called chocolate pattern, offering relatively few, but large, contact areas between adjacent heat transfer plates. The heat transfer pattern may be such that it offers a relatively strong flow resistance and high pressure drop which is typically associated with a more "dense" heat transfer pattern design. One common example of such a design is the so-called herringbone pattern, offering more, but smaller, contact areas between adjacent heat transfer plates. In some applications, hygiene is an important aspect and then a heat transfer pattern offering relatively few contact areas may be desired. One example of such a design is the so-called roller coaster pattern, which is described in U.S. Pat. No. 7,186,483. The roller coaster pattern comprises support ridges and support valleys arranged in longitudinal rows, and turbulence increasing corrugations extending between the rows. Even if the roller coaster pattern functions well, its thermal efficiency may be insufficient in certain types of applications.

SUMMARY

An object of the present invention is to provide a heat transfer plate which at least partly solves the above discussed problem of prior art. The basic concept of the invention is to provide the heat transfer plate with a hygienic heat transfer pattern having an increased thermal efficiency. The heat transfer plate, which is also referred to herein as just "plate", for achieving the object above is defined in the appended claims and discussed below.

A heat transfer plate according to the present invention comprises a first end portion, a second end portion and a center portion arranged between the first and second end portions. The first end portion, the center portion and the second end portion are arranged in succession along a longitudinal center axis dividing the heat transfer plate into a first and a second half. The first and second end portions each comprises a number of port holes. The center portion comprises a heat transfer area provided with a heat transfer pattern comprising support ridges and support valleys. The support ridges and support valleys longitudinally extend parallel to the longitudinal center axis of the heat transfer plate. The support ridges and support valleys each comprise an intermediate portion arranged between two end portions. A respective top portion of the support ridges extends in a first plane and a respective bottom portion of the support valleys extends in a second plane. The first and second planes are parallel to each other. The support ridges and support valleys are alternately arranged along or on a number=x, $x \geq 3$, of separated imaginary longitudinal straight lines, which extend parallel to the longitudinal center axis of the heat transfer plate, and along a number of separated imaginary transverse straight lines, which extend perpendicular to the longitudinal center axis of the heat transfer plate. The support ridges and support valleys are centered with respect to the imaginary longitudinal straight lines and extend between adjacent ones of the imaginary transverse straight lines. The heat transfer pattern further comprises turbulence ridges and turbulence valleys. A respective top portion of the turbulence ridges extends in a third plane, which is arranged between, and parallel to, the first and second planes, and a respective bottom portion of the turbulence valleys extends in a fourth plane, which is arranged between, and parallel to, the second and third planes. The turbulence ridges and turbulence valleys are alternately arranged, with a pitch between adjacent turbulence ridges and adjacent turbulence valleys, in interspaces between the imaginary longitudinal straight lines. The turbulence ridges and turbulence valleys connect the support ridges and support valleys along adjacent ones of the imaginary longitudinal straight lines. The heat transfer plate is characterized in that at least a plurality of the turbulence ridges and turbulence valleys, along at least a center portion of their longitudinal extension, extend inclined in relation to the transverse imaginary straight lines.

Herein, if not stated otherwise, the ridges and valleys of the heat transfer plate are ridges and valleys when a front side of the heat transfer plate is viewed. Naturally, what is a ridge as seen from the front side of the plate is a valley as seen from an opposing back side of the plate, and what is a valley as seen from the front side of the plate is a ridge as seen from the back side of the plate, and vice versa.

Especially a heat transfer plate intended for a gasketed plate heat exchanger may further comprise an outer edge portion enclosing the first and second end portions and the center portion, which outer edge portion comprises corrugations extending between and in the first and second planes. The complete outer edge portion, or only one or more portions thereof, may comprise corrugations. The corrugations may be evenly or unevenly distributed along the edge portion, and they may, or may not, all look the same. The corrugations define ridges and valleys which may give the edge portion a wave-like design. The corrugations may be arranged, at the front side of the heat transfer plate, to abut a first adjacent heat transfer plate, and at the opposing back side of the heat transfer plate, to abut a second adjacent heat transfer plate, when the heat transfer plate is arranged in a plate heat exchanger.

The heat transfer plate is arranged to be combined with other heat transfer plates in a plate pack. The heat transfer plates of the plate pack may all be of the same type. Alternatively, they may be of different types, as long as they are all configured according to claim 1.

The third and fourth planes may, or may not, be arranged at the same distance from a center plane extending half way between the first and second planes.

The turbulence ridges and turbulence valleys increase the heat transfer capacity of the heat transfer plate. The higher/deeper and more densely arranged the turbulence ridges and valleys are, the more they increase the heat transfer capacity.

The pitch between adjacent turbulence ridges and adjacent turbulence valleys is the distance between a reference point of one turbulence ridge or valley to a corresponding reference point of an adjacent turbulence ridge or valley in the same interspace.

The turbulence ridges and turbulence valleys extend between adjacent imaginary longitudinal straight lines to connect the support ridges and support valleys along the adjacent imaginary longitudinal straight lines.

In that the turbulence ridges and turbulence valleys, along at least part of their length, extend obliquely between the imaginary longitudinal straight lines, they may connect support ridges and support valleys which are not arranged between the same two imaginary transverse straight lines. "Rotation", "flipping" and "turning", in relation to each other, of two heat transfer plates, which have non-oblique turbulence ridges and valleys, may result in channels where the turbulence ridges or valleys of one plate end up directly aligned with the turbulence ridges or valleys of the other plate. Such channels may have a varying depth along a longitudinal center axis of the heat transfer plates which may result in an intermittent restriction of a flow through the channels. If the two heat transfer plates instead have oblique turbulence ridges and valleys, directly aligned turbulence ridges and valleys, and thus channels of varying depth, may be avoided, when the plates are "flipped" and "rotated" and "turned" in relation to each other.

The number of imaginary transverse straight lines may be an even or an odd number. The imaginary transverse straight lines may be equidistantly arranged across part of, or the complete, heat transfer area.

The number x of imaginary longitudinal straight lines may be an even or an odd number. The imaginary longitudinal straight lines may be equidistantly arranged across part of, or the complete, heat transfer area. On each of the first and second half of the heat transfer plate there is a number of complete interspaces, i.e. interspaces not divided by the longitudinal center axis. The number of complete interspaces on each of the first and second half may be $(x-1-1)/2$ if x is even, and $(x-1)/2$ if x is odd.

According to one embodiment of the invention, the number x of imaginary longitudinal straight lines is an even number and the number of interspaces is $x-1$. The longitudinal center axis divides a center interspace lengthwise, possibly in half, and $(x-2)/2$ complete interspaces are arranged on each of the first and a second half of the heat transfer plate. The center interspace is the interspace between imaginary longitudinal straight lines $x/2$ and $x/2+1$. The center interspace need not, but could, be centered with respect to the longitudinal center axis of the plate. This embodiment may make the heat transfer plate suitable for use in a plate pack comprising plates "rotated" in relation to each other and in a plate pack comprising plates "flipped" in relation to each other, but possibly not in a plate pack comprising plates "turned" in relation to each other. Naturally, the suitability is dependent on the design of the rest of the heat transfer plate in the plate pack.

The turbulence ridges and turbulence valleys of said at least a plurality of the turbulence ridges and turbulence valleys arranged in the complete interspaces on one of the first and the second half of the heat transfer plate may, along their center portion, extend in a smallest angle $\alpha$, $0<\alpha<90$, clockwise in relation to the transverse imaginary straight lines, i.e. in the second quadrant of a coordinate system. Further, the turbulence ridges and turbulence valleys of said at least a plurality of the turbulence ridges and turbulence valleys arranged in the rest of the interspaces may, along their center portion, extend in a smallest angle $\beta$, $0<\beta<90$, counter-clockwise in relation to the transverse imaginary straight lines, i.e. in the first quadrant of the coordinate system. Thereby, it may be avoided that opposing turbulence ridges and valleys of two adjacent heat transfer plates, which are configured like this, in a plate pack, extend parallel to each other, at least when the plates are "rotated" as well as "flipped" in relation to each other. Such parallel extension could result in unnecessary restriction of a flow between the plates. However, in a case where the number x of imaginary longitudinal straight lines is an even number, and the number of interspaces is an odd number, the turbulence ridges and valleys orientation in $(x-2)/2$ of the interspaces may be within the second quadrant, while the turbulence ridges and valleys orientation in $x/2$ of the interspaces may be within the first quadrant. Consequently, when the plates are "rotated" in relation to each other, the opposing turbulence ridges and valleys in the center interspaces could end up positioned parallel to each other, which could result in a locally limited restriction of a flow between the plates.

$\alpha$ may be different from $\beta$. Alternately, a may be equal to $\beta$. The latter option may result in that opposing turbulence ridges and valleys of two adjacent heat transfer plates, which are configured like this, in a plate pack, extend in the same way in relation to each other irrespective of whether the plates are "rotated" or "flipped" in relation to each other, at least within all interspaces but the center interspace.

The imaginary longitudinal straight lines may cross the imaginary transverse straight lines in imaginary cross points to form an imaginary grid. At least at a plurality of the imaginary cross points, one of the support ridges, one of the support valleys and two of the turbulence ridges may meet. These turbulence ridges are arranged in adjacent ones of the interspaces and form cross turbulence ridges. The cross turbulence ridges extending between two of the imaginary cross points form double-cross turbulence ridges. It is possible for the double-cross turbulence ridges to extend at least partly oblique and still between two imaginary cross points arranged on the same imaginary transverse straight line since the turbulence ridges may "join" the imaginary cross points at different locations along the width of the turbulence ridges. The cross turbulence ridges extending from one of the imaginary cross points to the intermediate portion of one of the support valleys form single-cross turbulence ridges. Depending on the design of the heat transfer pattern there may, or may not, be double-cross turbulence ridges, and the density or frequency of them may vary between heat transfer patterns. By having one of the support ridges, one of the support valleys and two of the turbulence ridges meet at the imaginary cross points, plate areas that are hard to form, i.e. having low formability, may be avoided. Thereby, the general intensity of the heat transfer pattern may be increased which may improve the heat transfer capacity of the plate.

At least a plurality of every third one of the cross turbulence ridges in one and the same interspace may be double-cross turbulence ridges, while the rest of the cross turbulence ridges are single-cross turbulence ridges.

The heat transfer plate may be such that, at least along x−1 of the imaginary longitudinal straight lines, one of the meeting cross turbulence ridges is a double-cross turbulence ridge, while the other one of the meeting cross turbulence ridges is a single-cross turbulence ridge.

Accordingly, if x is an even number, the two middle imaginary longitudinal straight lines, i.e. line no. x/2 and (x/2)+1, which may be the two imaginary longitudinal straight lines closest to the longitudinal center axis, may form center imaginary longitudinal straight lines. Along one of the center imaginary longitudinal straight lines, both of the meeting cross turbulence ridges may be double-cross turbulence ridges or both of the meeting cross turbulence ridges may be single-cross turbulence ridges. Along the rest of the imaginary longitudinal straight lines, one of the meeting cross turbulence ridges may be a double-cross turbulence ridge, while the other one of the meeting cross turbulence ridges may be a single-cross turbulence ridge. This embodiment may facilitate a change of the heat transfer pattern at said one of the center imaginary longitudinal straight lines.

Alternatively, if x is an odd number, the middle imaginary longitudinal straight line, i.e. line no. (x+1)/2, which may, or may not, coincide with the longitudinal center axis, may form a center imaginary longitudinal straight line. Along the center imaginary longitudinal straight line, both of the meeting cross turbulence ridges may be double-cross turbulence ridges or both of the meeting cross turbulence ridges may be single-cross turbulence ridges. Along the rest of the imaginary longitudinal straight lines, one of the meeting cross turbulence ridges may be a double-cross turbulence ridge, while the other one of the meeting cross turbulence ridges may be a single-cross turbulence ridge. This embodiment may facilitate a change of the heat transfer pattern at said one of the center imaginary longitudinal straight lines.

The middle imaginary longitudinal straight line/lines has/have an equal number of imaginary longitudinal straight lines on both sides but does/do not necessarily extend in the very center of the heat transfer plate. Thus, the middle imaginary longitudinal straight line/lines does/do not have to coincide/equidistantly deviate from the longitudinal center axis of the plate.

The heat transfer plate may be so constructed that the turbulence ridges extending between the intermediate portion of one of the support valleys and the intermediate portion of one of the support ridges form intermediate turbulence ridges. Depending on the design of the heat transfer pattern there may, or may not, be intermediate turbulence ridges. This embodiment enables further turbulence ridges, i.e. intermediate turbulence ridges, amongst the cross turbulence ridges which may increase the heat transfer capacity of the heat transfer plate.

The frequency or density of the intermediate turbulence ridges may vary. As an example, the heat transfer plate may be such that at least one of the intermediate turbulence ridges is arranged between the single-cross turbulence ridge and the double-cross turbulence ridge of at least a plurality of each pair of adjacent single-cross turbulence ridge and double-cross turbulence ridge within one and the same of the interspaces. As another example, the heat transfer plate may be such that at least a plurality of every fifth one of the turbulence ridges in one and the same interspace is an intermediate turbulence ridge, while the rest of the turbulence ridges are single-cross turbulence ridges.

The top portions of the support ridges and the bottom portions of the support valleys along one and the same of the imaginary longitudinal straight lines may be connected by support flanks. Further, the top portions of the turbulence ridges and the bottom portions of the turbulence valleys in one and the same interspace may be connected by turbulence flanks. At least a plurality of the turbulence ridges may have a first turbulence flank extending between the top portion and a first side of the heat transfer plate, and a second turbulence flank extending between the top portion and an opposite second side of the heat transfer plate. Thus, the first and second turbulence flanks of a turbulence ridge extend on opposite sides of the top portion, and along the longitudinal extension, of the turbulence ridge. For an essentially rectangular heat transfer plate, the first and second sides may be the short sides of the heat transfer plate. At least for a plurality of the double-cross turbulence ridges, the first turbulence flank and the second turbulence flank may be connected to a respective one of the support flanks at the corresponding ones of the imaginary cross points. This is one example of how the double-cross turbulence ridges can extend at least partly oblique and still between two imaginary cross points arranged on the same imaginary transverse straight line.

At least for a plurality of the single-cross turbulence ridges, one of the first and second turbulence flanks may be connected to the support flank at the corresponding one of the imaginary cross points. Further, the other one of the first and second turbulence flanks may be connected to the intermediate portion of the corresponding one of the support valleys.

At least a plurality of the single-cross turbulence ridges may, along at least one of two end portions of their longitudinal extension, extend essentially parallel to the transverse imaginary straight lines. Alternatively/additionally, at least a plurality of the double-cross turbulence ridges may, along two end portions of their longitudinal extension, extend essentially parallel to the transverse imaginary straight lines. The end portions are arranged on opposite sides of the center portion. According to this embodiment, said plurality of the double-cross turbulence ridges may have the shape of a stretched 'Z'. Further, as will be discussed later on, this embodiment may enable for the turbulence flanks to extend in line with the support flanks.

The center portion of each of the turbulence ridges comprises a first end point and a second end point arranged along a respective longitudinal center line of the center portion. For a plurality of the turbulence ridges, the first end point may be displaced, in relation to the second end point, (n+0.5) x the pitch between the turbulence ridges, parallel to the longitudinal center axis of the heat transfer plate, where n is an integer. Then, the value of n determines how steep the turbulence ridges are; the larger n is, the steeper the turbulence ridges are. For example, n could be 0, 1 or more than 1. If n=1, the displacement between the first and second end points is 1.5 x the pitch and the turbulence ridges are relatively steep. Such a heat transfer pattern may typically be associated with a relatively low heat transfer capacity and/or flow resistance. If n=0, the displacement between the first and second end points is 0.5 x the pitch and the turbulence ridges are less steep. Such a heat transfer pattern may typically be associated with a relatively high heat transfer capacity and/or flow resistance.

It should be stressed that the advantages of most, if not all, of the above discussed features of the inventive heat transfer plate appear when the heat transfer plate is combined with other suitably constructed heat transfer plates in a plate pack.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1:
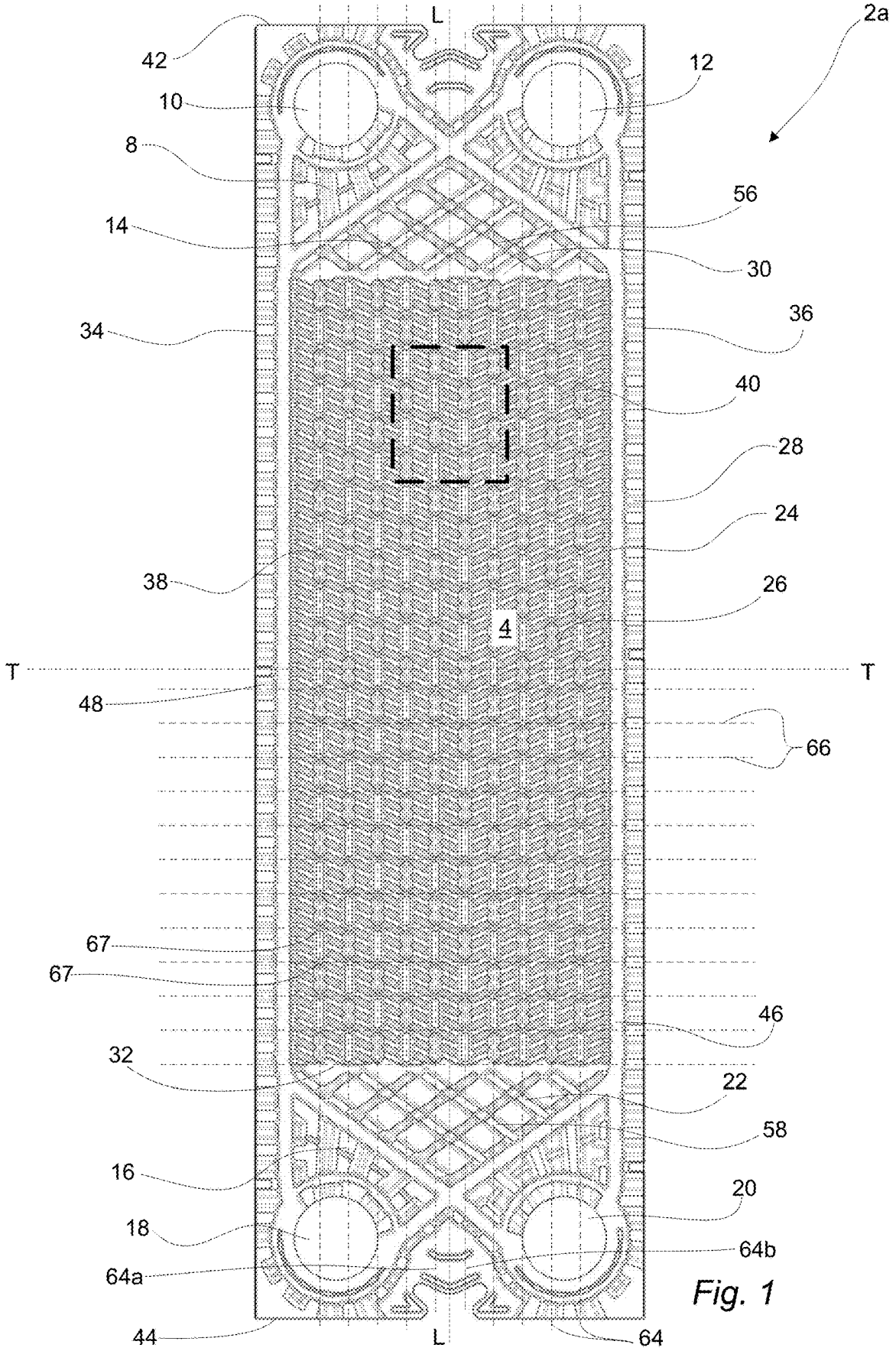
FIG. 1 is a schematic plan view of a heat transfer plate.
Figure 2:
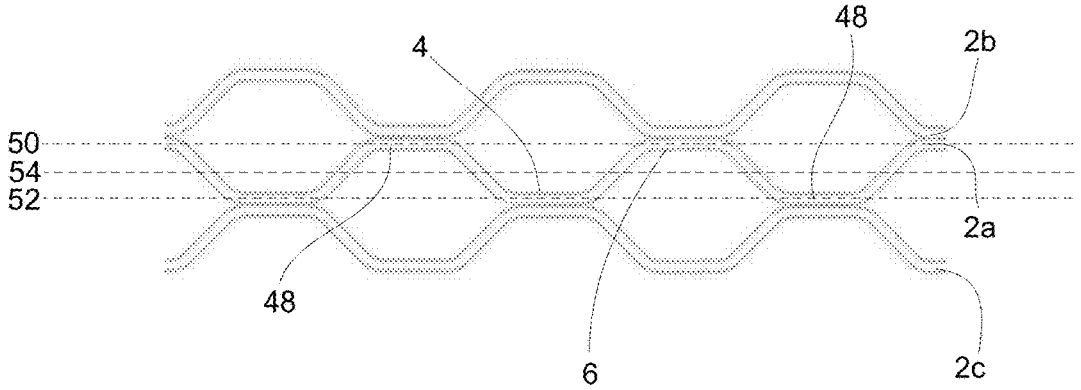
FIG. 2 illustrates abutting outer edges of adjacent heat transfer plates in a plate pack, as seen from the outside of the plate pack.

FIG. 1 shows a heat transfer plate 2*a* of a gasketed plate heat exchanger as described by way of introduction. The gasketed PHE, which is not illustrated in full, comprises a pack of heat transfer plates 2 like the heat transfer plate 2*a*, i.e. a pack of similar heat transfer plates, separated by gaskets, which also are similar and which are not illustrated. With reference to FIG. 2, in the plate pack, a front side 4 (illustrated in FIG. 1) of the plate 2*a* faces an adjacent plate 2*b* while a back side 6 (not visible in FIG. 1 but indicated in FIG. 2) of the plate 2*a* faces another adjacent plate 2*c*.

With reference to FIG. 1, the heat transfer plate 2*a* is an essentially rectangular sheet of stainless steel. It comprises a first end portion 8, which in turn comprises a first port hole 10, a second port hole 12 and a first distribution area 14. The plate 2*a* further comprises a second end portion 16, which in turn comprises a third port hole 18, a fourth port hole 20 and a second distribution area 22. The plate 2*a* further comprises a center portion 24, which in turn comprises a heat transfer area 26, and an outer edge portion 28 extending around the first and second end portions 8 and 16 and the center portion 24. The first end portion 8 adjoins the center portion 24 along a first borderline 30 while the second end portion 16 adjoins the center portion 24 along a second borderline 32. As is clear from FIG. 1, the first end portion 8, the center portion 24 and the second end portion 16 are arranged in succession along a longitudinal center axis L of the plate 2*a*, which extends half way between, and parallel to, first and second opposing long sides 34, 36 of the plate 2*a*. The longitudinal center axis L divides the plate 2*a* into first and second halves 38, 40. Further, the longitudinal center axis L extends perpendicular to a transverse center axis T of the plate 2*a*, which extends half way between, and parallel to, first and second opposing short sides 42, 44 of the plate 2*a*. Also, the heat transfer plate 2*a* comprises, as seen from the front side 4, a front gasket groove 46 and, as seen from the back side 6, a back gasket groove (not illustrated). The front and back gasket grooves are partly aligned with each other and arranged to receive a respective gasket.

The heat transfer plate 2*a* is pressed, in a conventional manner, in a pressing tool, to be given a desired structure, more particularly different corrugation patterns within different portions of the heat transfer plate. As was discussed by way of introduction, the corrugation patterns are optimized for the specific functions of the respective plate portions. Accordingly, the first and second distribution areas 14, 22 are provided with a distribution pattern, and the heat transfer area 26 is provided with a heat transfer pattern differing from the distribution pattern. Further, the outer edge portion 28 comprises corrugations 48 which make the outer edge portion 28 stiffer and, thus, the heat transfer plate 2*a* more resistant to deformation. Further, the corrugations 48 form a support structure in that they are arranged to abut corrugations of the adjacent heat transfer plates in the plate pack of the PHE. With reference again to FIG. 2, illustrating the peripheral contact between the heat transfer plate 2*a* and the two adjacent heat transfer plates 2*b* and 2*c* of the plate pack, the corrugations 48 extend between and in a first plane 50 and a second plane 52, which are parallel to the figure plane of FIG. 1. A center plane 54 extends half way between the first and second planes 50 and 52, and a respective bottom of the front gasket groove 46 and back gasket groove extends in this center plane 54, i.e. in so called half plane.

The distribution pattern is of so-called chocolate type and comprises elongate distribution ridges 56 and distribution valleys 58 arranged so as to form a respective grid within each of the first and second distribution areas 14, 22. A respective top portion of the distribution ridges 56 extends in the first plane 50 and a respective bottom portion of the distribution valleys 58 extends in the second plane 52. The distribution ridges 56 and distribution valleys 58 are arranged to abut distribution ridges and distribution valleys of the adjacent heat transfer plates in the plate pack of the PHE. The chocolate-type distribution pattern is well-known and will not be described in further detail herein.

Figure 3:
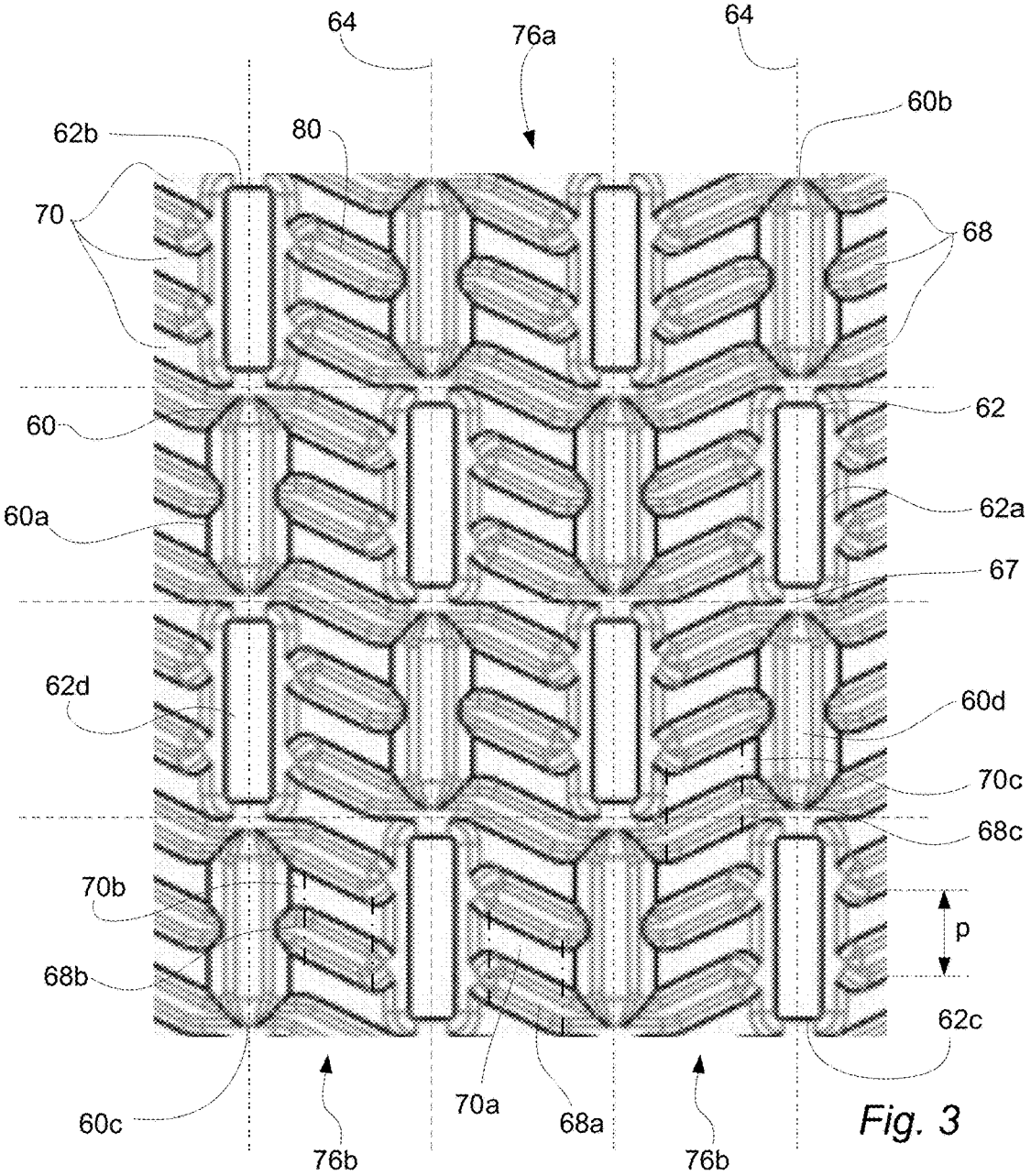
FIG. 3 is an enlargement of a portion of the heat transfer plate in FIG. 1, FIG. 4 schematically illustrates a cross section of a support ridge and a support valley of the heat transfer plate in FIG. 1, FIG. 5 schematically illustrates a cross section of a turbulence ridge and a turbulence valley of the heat transfer plate in FIG. 1, FIG. 6-8 each contains an enlargement of a portion of the heat transfer plate in FIG. 1, FIG. 9 schematically illustrates an alternative heat transfer pattern, and FIG. 10 schematically illustrates another alternative heat transfer pattern.
Figure 4:
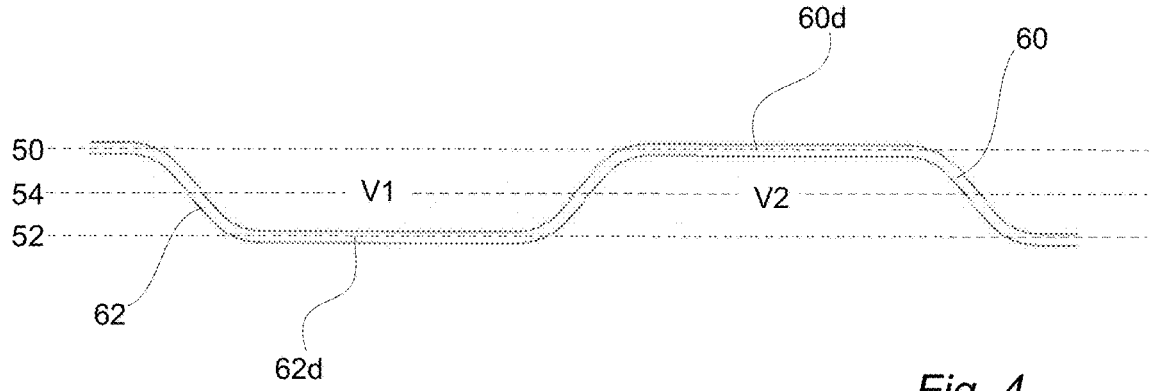

With reference to FIG. 3, which contains an enlargement of the heat transfer area portion within the box in dashed lines in FIG. 1, the heat transfer pattern comprises elongate support ridges 60 and elongate support valleys 62 longitudinally extending parallel to the longitudinal center axis L of the plate 2*a*. Each of the support ridges 60 comprises an intermediate portion 60*a* arranged between two end portions 60*b*, 60*c* and each of the support valleys 62 comprises an intermediate portion 62*a* arranged between two end portions 62*b*, 62*c*. Further, with reference to FIG. 4, which illustrates a center cross section of the support ridges 60 and the support valleys 62 taken parallel to their longitudinal extension, i.e. parallel to the longitudinal center axis L of the plate 2*a*, a respective top portion 60*d* of the support ridges 60 extends in the first plane 50 while a respective bottom portion 62*d* of the support valleys 62 extends in the second plane 52.

With reference again to FIG. 1, the support ridges 60 and the support valleys 62 are alternately arranged along x=10 equidistantly arranged imaginary longitudinal straight lines 64 extending parallel to the longitudinal center axis L of the plate 2*a*. The imaginary longitudinal straight lines 64 extend through a respective center of the support ridges 60 and support valleys 62. Further, the support ridges 60 and the support valleys 62 are alternately arranged along a number of equidistantly arranged imaginary transverse straight lines 66 extending parallel to the transverse center axis T of the plate 2*a*. Only half of these imaginary transverse straight lines 66 are illustrated in FIG. 1. The support ridges 60 and support valleys 62 are arranged between the imaginary transverse straight lines 66. The imaginary longitudinal straight lines 64 and the imaginary transverse straight lines 66 cross each other in imaginary cross points 67 to form an imaginary grid.

Figure 5:
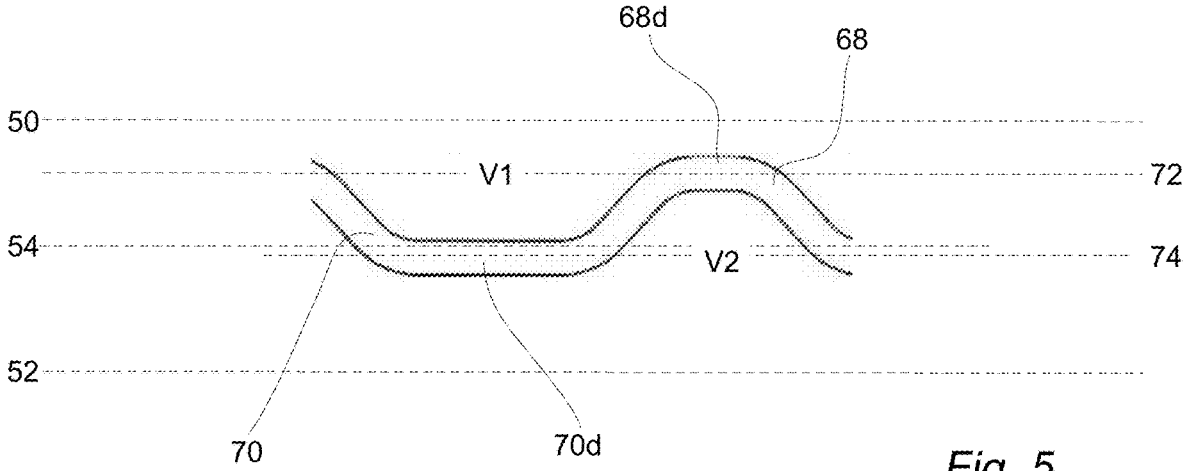

With reference to FIG. 3, the heat transfer pattern further comprises elongate turbulence ridges 68 and elongate turbulence valleys 70. Each of the turbulence ridges 68 comprises a center portion 68*a* arranged between two end portions 68*b*, 68*c*, and each of the turbulence valleys 70 comprises a center portion 70*a* arranged between two end portions 70*b*, 70*c*. The borders between the center and end portions for some of the turbulence ridges and turbulence valleys are illustrated with dash-dotted lines in FIG. 3. Further, with reference to FIG. 5, which illustrates a center portion cross section of the turbulence ridges 68 and the turbulence valleys 70 taken perpendicular to their longitudinal extension, a respective top portion 68*d* of the turbulence ridges 68 extends in a third plane 72 while a respective bottom portion 70*d* of the turbulence valleys 70 extends in a fourth plane 74. The third plane 72 is arranged between the first plane 50 and the center plane 54 while the fourth plane 74 lies just slightly below the center plane 54, i.e. between the second plane 52 and the center plane 54. As the turbulence ridges and valleys 68, 70 are positioned and designed, within the heat transfer area 26, a first volume V1 enclosed by the plate 2*a* and the first plane 50 will be smaller than a second volume V2 enclosed by the plate 2*a* and the second plane 52.

With reference to FIGS. 1 and 3, the turbulence ridges 68 and the turbulence valleys 70 are alternately arranged with a pitch p in interspaces 76 (76*a*, 76*b*) between adjacent ones of the imaginary longitudinal straight lines 64. Arranged like that, the turbulence ridges 68 and the turbulence valleys 70 connect the support ridges 60 and the support valleys 62 along adjacent ones of the imaginary longitudinal straight lines 64. The turbulence ridges 68 and turbulence valleys 70 are also alternately arranged with the pitch p between the outermost ones of the imaginary longitudinal straight lines 64 and the first and second opposing long sides 34, 36 of the plate 2*a*. Since the number x of imaginary longitudinal straight lines 64 is 10, there is 9 interspaces 76. The longitudinal center axis L of the plate 2*a* lengthwise divides a center interspace 76*a* in half which leaves 4 complete interspaces 76*b* on each side of the longitudinal center axis L of the plate 2*a*. The imaginary longitudinal straight lines 64 defining the center interspace 76*a* form center imaginary longitudinal straight lines 64*a*, 64*b*.

The extension of the turbulence ridges 68 determines the extension of the turbulence valleys 70. Therefore, the rest of the description will be focused on the turbulence ridges 68.

Figure 6:
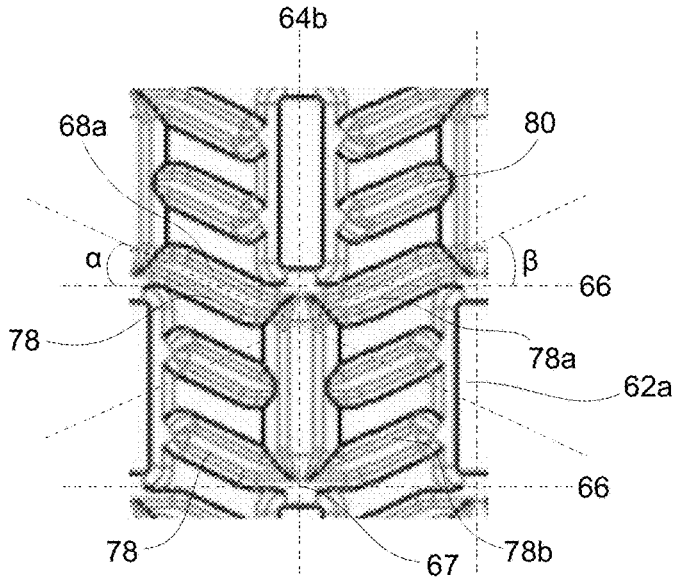

As is clear from FIGS. 1 and 3, the turbulence ridges 68, or more particularly the center portion 68*a* thereof, extend obliquely in relation to the transverse imaginary straight lines 66. At the center imaginary longitudinal straight line 64*b* the heat transfer pattern changes. More particularly, with reference to FIG. 6, to the left (as seen in FIGS. 1 and 6) of the line 64*b*, the center portions 68*a* of the turbulence ridges 68 extend in a smallest angle $\alpha$ (largest angle=$\alpha$+180) degrees clockwise in relation to the transverse imaginary straight lines 66. Further, to the right (as seen in FIGS. 1 and 6) of the line 64*b*, the center portions 68*a* of the turbulence ridges 68 extend in a smallest angle $\beta$ (largest angle=$\beta$+180) degrees counter-clockwise in relation to the transverse imaginary straight lines 66. Here, $\alpha=\beta=25$ but this may not be the case in alternative embodiments in which a may differ from 13 and a and p may have other values within the range 15-75.

Figure 7:
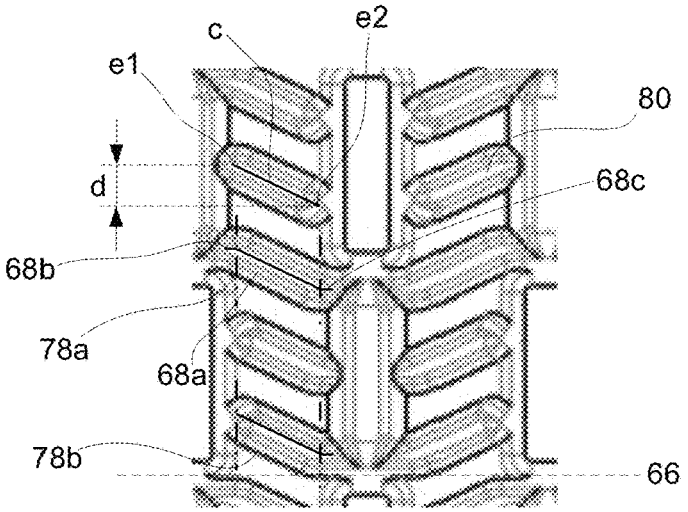

With reference to FIG. 7, the center portion 68*a* of each of the turbulence ridges 68 comprises a first end point e1 and a second end point e2 arranged along a respective longitudinal center line c of the center portion 68*a*. The oblique extension of the center portion 68*a* of the turbulence ridges 68 results in a relative displacement d of the first end point e1 in relation to the second end point e2. The displacement d is half the pitch p of the turbulence ridges 68 and the turbulence valleys 70 parallel to the longitudinal center axis L of the plate 2*a*.

With reference to FIGS. 1, 3 and 6, the heat transfer pattern contains different types of turbulence ridges 68. At each of the imaginary cross points 67, except for at the cross points along the outermost ones of the imaginary transverse straight lines 66, one of the support ridges 60, one of the support valleys 62 and two of the turbulence ridges 68, which are arranged in adjacent ones of the interspaces 76, meet. These turbulence ridges form cross turbulence ridges 78. Some of the cross turbulence ridges 78 extend between two of the imaginary cross points 67 and form double-cross turbulence ridges 78*a*, while others extend from one of the imaginary cross points 67 to the intermediate portion 62*a* of one of the support valleys 62 and form single-cross turbulence ridges 78*b*. In this specific embodiment, in each one of the interspaces 76, every third one of the cross turbulence ridges 78 is a double-cross turbulence ridge 78*a* while the other cross turbulence ridges are single-cross turbulence ridges 78*b*. As is clear from FIG. 1, along the center imaginary longitudinal straight line 64*b* where the heat transfer pattern changes, either both of the meeting cross turbulence ridges 78 are double-cross turbulence ridges 78*a*, or both of the meeting cross turbulence ridges 78 are single-cross turbulence ridges 78*b*. Along the rest of the imaginary longitudinal straight lines 64, one of the meeting cross turbulence ridges 78 is a double-cross turbulence ridge

78*a* while the other one is a single-cross turbulence ridge 78*b*. The turbulence ridges 68 extending between the intermediate portion 60*a* of one of the support ridges 60 and the intermediate portion 62*a* of one of the support valleys 62 form intermediate turbulence ridges 80. In this specific embodiment, in each one of the interspaces 76, one intermediate turbulence ridge 80 is arranged between the double-cross turbulence ridge 78*a* and the single-cross turbulence ridge 78*b* of each pair of adjacent double-cross turbulence ridge and single-cross turbulence ridge.

The configurations of the double-cross turbulence ridges 78*a*, the single-cross turbulence ridges 78*b* and the intermediate turbulence ridges 80 are different from each other. For example, as is illustrated in FIG. 7, the end portions 68*b* and 68*c* of the double-cross turbulence ridges 78*a* extend parallel to the transverse imaginary straight lines 66. Thereby, the double-cross turbulence ridges 78*a* have the shape of a stretched 'Z'. Further, one of the end portions 68*b* and 68*c* of the single-cross turbulence ridges 78*b* extend parallel to the transverse imaginary straight lines 66.

Figure 8:
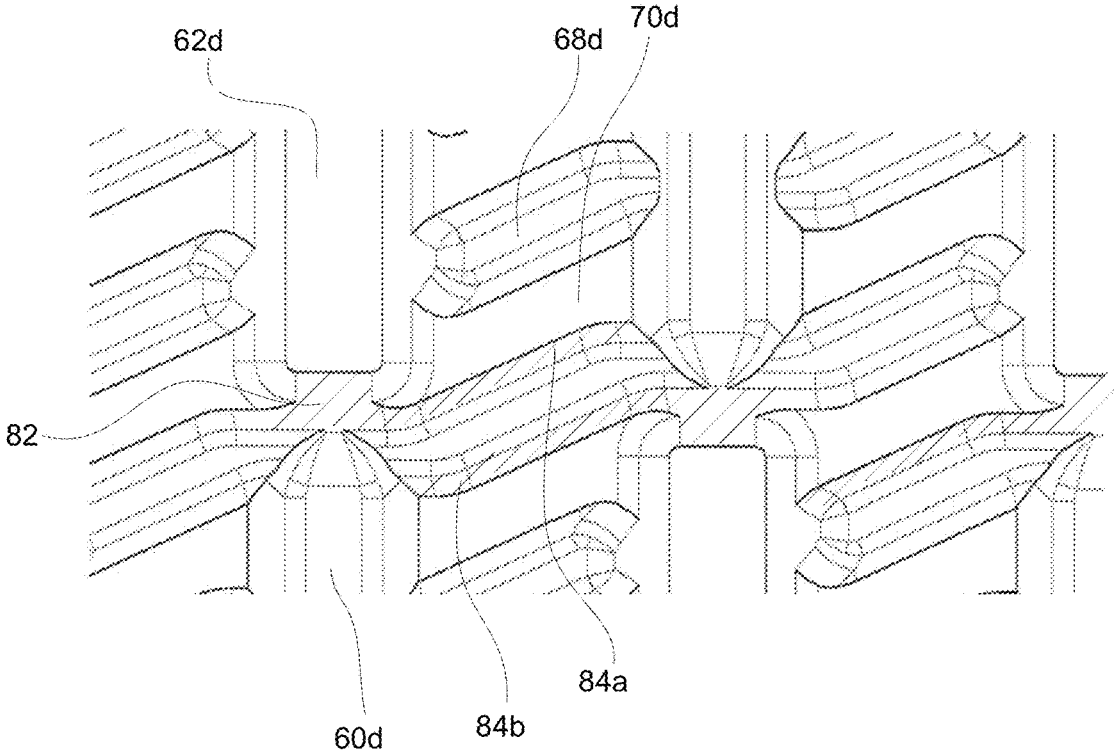

With reference to FIGS. 1 and 8, the top portions 60*d* of the support ridges 60 and the bottom portions 62*d* of the support valleys 62 along each of the imaginary longitudinal straight lines 64 are connected by support flanks 82. Further, the top portion 68*d* of each of the turbulence ridges 68 is connected to the bottom portion 70*d* of the adjacent ones of the turbulence valleys 70 within the same one of the interspaces by turbulence flanks 84 (84*a*, 84*b*). Each of the turbulence ridges 68, except for some at the outermost ones of the transverse imaginary straight lines 66, has a first turbulence flank 84*a* extending between the top portion 68*d* of the turbulence ridge 68 and the first short side 42 of the plate 2*a*, and a second turbulence flank 84*b* extending between the top portion 68*d* of the turbulence ridge 68 and the second short side 44 of the plate 2*a*. The first and second turbulence flanks 84*a*, 84*b* of each of the double-cross turbulence ridges 78*a*, except for some at the outermost ones of the transverse imaginary straight lines 66, are connected to a respective one of the support flanks 82 at the corresponding ones of the imaginary crossing points 67. Further, for each of the single-cross turbulence ridges 78*b*, except for some at the outermost ones of the transverse imaginary straight lines 66, one of the first and second turbulence flanks 84*a*, 84*b* is connected to the support flank 82 at the corresponding one of the imaginary crossing points 67. As is illustrated with hatching in FIG. 8, the support flanks 82 are arranged flush with the respective turbulence flanks 84 at the transition between them such that the respective turbulence flanks 84 form "extensions" of the support flanks 82.

As previously said, in the plate pack, the plate 2*a* is arranged between the plates 2*b* and 2*c*. With the above specified design of the heat transfer pattern, the plates 2*b* and 2*c* may be arranged either "flipped" or "rotated" in relation to the plate 2*a*.

If the plates 2*b* and 2*c* are arranged "flipped" in relation to the plate 2*a*, the front side 4 and back side 6 of the plate 2*a* face the front side 4 of the plate 2*b* and the back side 6 of plate 2*c*, respectively. This means that the support ridges 60 of the plate 2*a* will abut the support ridges of the plate 2*b* while the support valleys 62 of the plate 2*a* will abut the support valleys of the plate 2*c*. Further, the turbulence ridges 68 of the plate 2*a* will face but not abut, and extend with an angle $2\alpha=2\beta$ in relation to, the turbulence ridges of the plate 2*b*, while the turbulence valleys 70 of the plate 2*a* will face but not abut, and extend with an angle $2\alpha=2\beta$ in relation to, the turbulence valleys of the plate 2*c*. Within the heat transfer area 26, the plates 2*a* and 2*b* will form a channel of volume $2\times V1$, while the plates 2*a* and 2*c* will form a channel of volume $2\times V2$, i.e. two asymmetric channels since $V1<V2$.

If the plates 2*b* and 2*c* are arranged "rotated" in relation to the plate 2*a*, the front side 4 and back side 6 of the plate 2*a* face the back side 6 of the plate 2*b* and the front side 4 of the plate 2*c*, respectively. This means that the support ridges 60 of the plate 2*a* will abut the support valleys of the plate 2*b* while the support valleys 62 of plate 2*a* will abut the support ridges of the plate 2*c*. Further, the turbulence ridges 68 of the plate 2*a* will face but not abut the turbulence valleys of the plate 2*b*, while the turbulence valleys 70 of the plate 2*a* will face but not abut the turbulence ridges of the plate 2*c*. Within all interspaces 76 except for the center interspace 76*a*, the turbulence ridges 68 and turbulence valleys 70 of the plate 2*a* will extend with an angle $2\alpha=2\beta$ in relation to the turbulence valleys of the plate 2*b* and the turbulence ridges of the plate 2*c*, respectively. Within the center interspace 76*a* the turbulence ridges 68 and turbulence valleys 70 of the plate 2*a* will extend parallel to the turbulence valleys of the plate 2*b* and the turbulence ridges of the plate 2*c*, respectively. Within the heat transfer area 26, the plates 2*a* and 2*b* will form a channel of volume $V1+V2$, while the plates 2*a* and 2*c* will form a channel of volume $V1+V2$, i.e. two symmetric channels.

The above described embodiment of the present invention should only be seen as an example. A person skilled in the art realizes that the embodiment discussed can be varied in a number of ways without deviating from the inventive conception.

Figure 9:
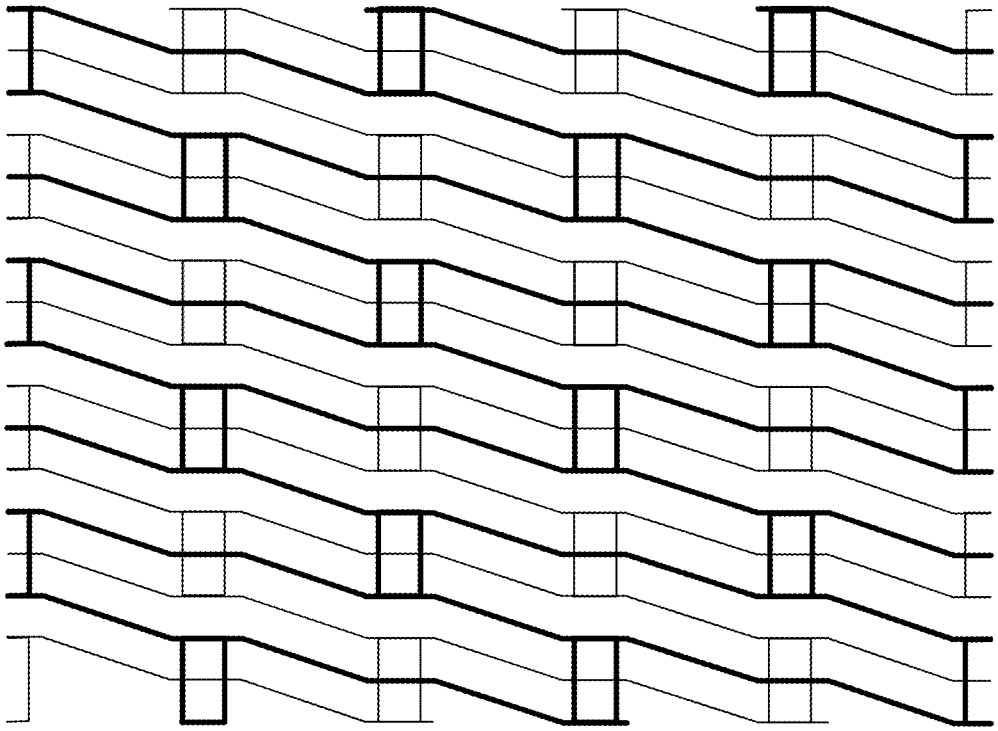
Figure 10:
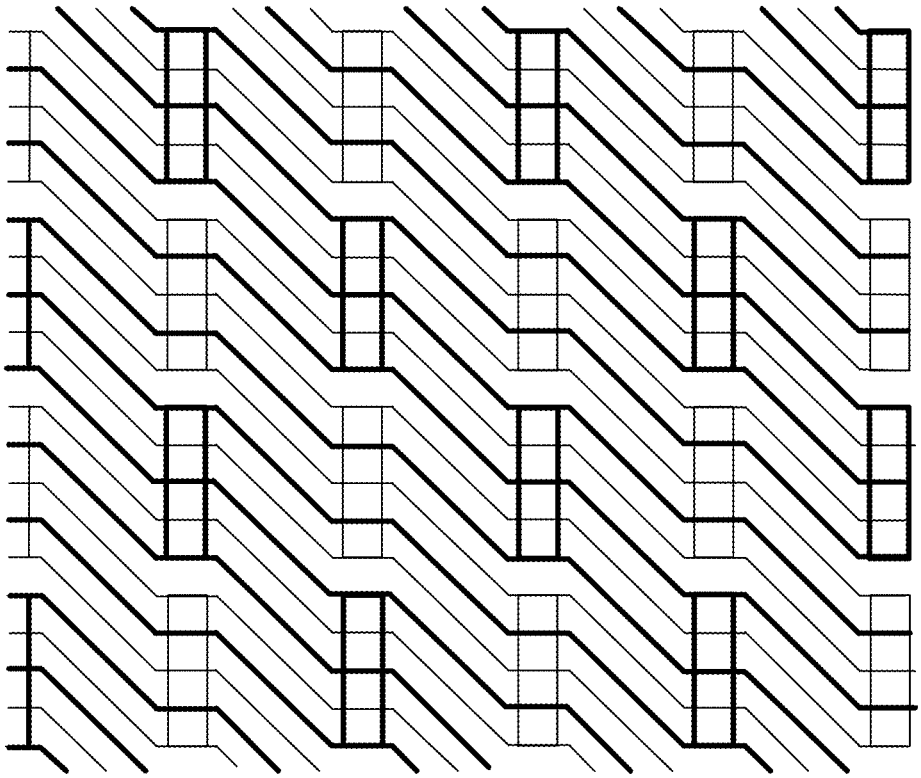

For example, the heat transfer pattern may comprise more or less and even no intermediate turbulence ridges. Further, the heat transfer pattern may comprise no double-cross turbulence ridges. FIGS. 9 and 10 illustrate, highly schematically, two alternative heat transfer patterns. In these figures, all ridges are illustrated in bold lines while all valleys are illustrated in thin lines. Further, the rectangles represent the support ridges and support valleys, while the oblique lines represent the center of the turbulence ridges and turbulence valleys.

Starting with FIG. 9, this illustrates a heat transfer pattern comprising support ridges and support valleys similar to the above support ridges and support valleys 60 and 62, only shorter. Further, the heat transfer pattern comprises double-cross turbulence ridges and single-cross turbulence ridges similar to the above double-cross and single-cross turbulence ridges 78*a* and 78*b*. However, the heat transfer pattern comprises no intermediate turbulence ridges similar to the above intermediate turbulence ridges 80. Instead, every third one of the turbulence ridges is a double-cross turbulence ridge, while the other turbulence ridges are single-cross turbulence ridges.

Moving on with FIG. 10, this illustrates a heat transfer pattern comprising support ridges and support valleys similar to the above support ridges and support valleys 60 and 62, only longer. Further, the heat transfer pattern comprises single-cross turbulence ridges and intermediate turbulence ridges similar to the above single-cross turbulence ridges 78*b* and intermediate turbulence ridges 80. However, the heat transfer pattern comprises no double-cross turbulence ridges similar to the above double-cross turbulence ridges 78*a*. Instead, every fifth one of the turbulence ridges is an intermediate turbulence ridge, while the other turbulence ridges are single-cross turbulence ridges. The relative displacement of first end points of the turbulence ridges in relation to second end points of the turbulence ridges corresponding to the displacement d above is 1.5 x the pitch p of the turbulence ridges, i.e. three times the displacement d above. Thus, the turbulence ridges and valleys are steeper in the heat transfer pattern in FIG. 10 than in the above described heat transfer pattern.

As another example, the number of imaginary longitudinal straight lines x need not be 10 but could be more or less. If x is an odd number, then the middle imaginary longitudinal straight line forms a center imaginary longitudinal straight line, corresponding to the center imaginary longitudinal straight line 64*b* in the above described heat transfer pattern, where the heat transfer pattern changes. With a heat transfer pattern designed as in the first described embodiment, along the middle imaginary longitudinal straight line, both of the meeting cross turbulence ridges are double-cross turbulence ridges or both of the meeting cross turbulence ridges are single-cross turbulence ridges. Along the rest of the imaginary longitudinal straight lines, one of the meeting cross turbulence ridges is a double-cross turbulence ridge while the other one of the meeting cross turbulence ridges is a single-cross turbulence ridge. Plates provided with such a pattern could be "flipped" or "turned" but possibly not "rotated" in relation to each other.

As yet another example, in case of x being an even number, the longitudinal center axis of the plate need not divide the center interspace in half. Similarly, in case of x being an odd number, the middle imaginary longitudinal straight line need not coincide with the longitudinal center axis of the plate.

Further, the heat transfer pattern need not change at a center imaginary longitudinal straight line like above. For example, the turbulence ridges and turbulence valleys could instead have the same orientation within the complete heat transfer pattern. Plates provided with such a pattern could be "flipped" or "turned" but possibly not "rotated" in relation to each other.

Naturally, the distribution pattern need not be of chocolate-type but may be of other types.

The heat transfer plate need not be asymmetric but could be symmetric. Accordingly, with reference to FIG. 5, the plate could be designed such that V1=V2.

The plate pack described above contains only plates of one type. The plate pack could instead comprise plates of two or more different types, such as plates having differently configurated heat transfer patterns and/or distribution patterns.

The support ridges and valleys, and the single- and double-cross turbulence ridges and the intermediate turbulence ridges as well as the corresponding valleys, need not all have the above described configuration but their design could differ.

The present invention is not limited to gasketed plate heat exchangers but could also be used in welded, semi-welded, brazed and fusion-bonded plate heat exchangers.

The heat transfer plate need not be rectangular but may have other shapes, such as essentially rectangular with rounded corners instead of right corners, circular or oval. The heat transfer plate need not be made of stainless steel but could be of other materials, such as titanium or aluminium.

It should be stressed that the attributes front, back, first, second, third, etc. is used herein just to distinguish between details and not to express any kind of orientation or mutual order between the details.

Further, it should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate comprising a first end portion, a center portion and a second end portion arranged in succession along a longitudinal center axis dividing the heat transfer plate into a first and a second half, the first and second end portions each comprising a number of port holes, the center portion comprising a heat transfer area provided with a heat transfer pattern comprising support ridges and support valleys, which support ridges and support valleys longitudinally extend parallel to the longitudinal center axis of the heat transfer plate, and which support ridges and support valleys each comprise an intermediate portion arranged between two end portions, a respective top portion of the support ridges extending in a first plane and a respective bottom portion of the support valleys extending in a second plane, which first and second planes are parallel to each other, the support ridges and support valleys being alternately arranged along a number x of separated imaginary longitudinal straight lines extending parallel to the longitudinal center axis of the heat transfer plate and along a number of separated imaginary transverse straight lines extending perpendicular to the longitudinal center axis of the heat transfer plate, the support ridges and support valleys being centered with respect to the imaginary longitudinal straight lines and extending between adjacent ones of the imaginary transverse straight lines, the heat transfer pattern further comprising turbulence ridges and turbulence valleys, a respective top portion of the turbulence ridges extending in a third plane arranged between, and parallel to, the first and second planes, and a respective bottom portion of the turbulence valleys extending in a fourth plane arranged between, and parallel to, the second and third planes, the turbulence ridges and turbulence valleys being alternately arranged, with a pitch between adjacent turbulence ridges and adjacent turbulence valleys, in interspaces between the imaginary longitudinal straight lines and connecting the support ridges and support valleys along adjacent ones of the imaginary longitudinal straight lines, at least a plurality of the turbulence ridges and turbulence valleys along at least a center portion of their longitudinal extension extend inclined in relation to the transverse imaginary straight lines, the interspaces between the imaginary longitudinal straight lines including a first plurality of interspaces positioned immediately adjacent one another on the first half of the heat transfer plate and a second plurality of interspaces positioned immediately adjacent one another on the second half of the heat transfer plate, a majority of the turbulence ridges and turbulence valleys in each of the first plurality of interspaces extending along their center portion at an angle $\alpha$, $0<\alpha<90$ degrees, clockwise in relation to the transverse imaginary straight lines, and a majority of the turbulence ridges and turbulence valleys in each of the second plurality of interspaces extending along their center portion at an angle $\beta$, $0<\beta<90$ degrees, counter-clockwise in relation to the transverse imaginary straight lines.

2. A heat transfer plate according to claim 1, wherein the number x of imaginary longitudinal straight lines is an even number and the number of interspaces is $x-1$, wherein the longitudinal center axis divides a center interspace lengthwise and $(x-2)/2$ complete interspaces are arranged on each of the first and a second half of the heat transfer plate.

3. A heat transfer plate according to claim 1, wherein the first plurality of interspaces positioned immediately adjacent one another on the first half of the heat transfer plate include four interspaces, and the second plurality of interspaces positioned immediately adjacent one another on the second half of the heat transfer plate include four interspaces, all the turbulence ridges and turbulence valleys in each of the four interspaces of the first plurality of interspaces extending along their center portion at the angle α clockwise in relation to the transverse imaginary straight lines, and all the turbulence ridges and turbulence valleys in each of the four interspaces of the second plurality of interspaces extending along their center portion at the angle β counter-clockwise in relation to the transverse imaginary straight lines.

4. A heat transfer plate according to claim 3, wherein α equals β.

5. A heat transfer plate according to claim 1, wherein the imaginary longitudinal straight lines cross the imaginary transverse straight lines in imaginary cross points to form an imaginary grid, and wherein, at least at a plurality of the imaginary cross points, one of the support ridges, one of the support valleys and two of the turbulence ridges, which turbulence ridges are arranged in adjacent ones of the interspaces and form cross turbulence ridges, meet, wherein the cross turbulence ridges extending between two of the imaginary cross points form double-cross turbulence ridges, and the cross turbulence ridges extending from one of the imaginary cross points to the intermediate portion of one of the support valleys form single-cross turbulence ridges.

6. A heat transfer plate according to claim 5, wherein at least a plurality of every third one of the cross turbulence ridges in one and the same interspace is a double-cross turbulence ridge, while the rest of the cross turbulence ridges are single-cross turbulence ridges.

7. A heat transfer plate according to claim 5, wherein, if x is an even number, the two middle imaginary longitudinal straight lines form center imaginary longitudinal straight lines, wherein, along one of the center imaginary longitudinal straight lines, both of the meeting cross turbulence ridges are double-cross turbulence ridges or both of the meeting cross turbulence ridges are single-cross turbulence ridges, wherein along the rest of the imaginary longitudinal straight lines, one of the meeting cross turbulence ridges is a double-cross turbulence ridge, while the other one of the meeting cross turbulence ridges is a single-cross turbulence ridge.

8. A heat transfer plate (2*a*) according to claim 5, wherein, if x is an odd number, the middle imaginary longitudinal straight line form a center imaginary longitudinal straight line, wherein, along the center imaginary longitudinal straight line, both of the meeting cross turbulence ridges are double-cross turbulence ridges or both of the meeting cross turbulence ridges are single-cross turbulence ridges, wherein along the rest of the imaginary longitudinal straight lines, one of the meeting cross turbulence ridges is a double-cross turbulence ridge, while the other one of the meeting cross turbulence ridges is a single-cross turbulence ridge.

9. A heat transfer plate according to claim 5, wherein the turbulence ridges extending between the intermediate portion of one of the support valleys and the intermediate portion of one of the support ridges form intermediate turbulence ridges.

10. A heat transfer plate according to claim 9, wherein at least one of the intermediate turbulence ridges is arranged between the single-cross turbulence ridge and the double-cross turbulence ridge of at least a plurality of each pair of adjacent single-cross turbulence ridge and double-cross turbulence ridge within one and the same of the interspaces.

11. A heat transfer plate according to claim 9, wherein at least a plurality of every fifth one of the turbulence ridges in one and the same interspace is an intermediate turbulence ridge, while the rest of the turbulence ridges are single-cross turbulence ridges.

12. A heat transfer plate according to claim 5, wherein the top portions of the support ridges and the bottom portions of the support valleys along one and the same of the imaginary longitudinal straight lines are connected by support flanks, wherein the top portions of the turbulence ridges and the bottom portions of the turbulence valleys in one and the same interspace are connected by turbulence flanks, wherein at least a plurality of the turbulence ridges has a first turbulence flank extending between the top portion and a first side of the heat transfer plate, and a second turbulence flank extending between the top portion and an opposite second side of the heat transfer plate, and wherein, at least for a plurality of the double-cross turbulence ridges, the first turbulence flank and the second turbulence flank are connected to a respective one of the support flanks at the corresponding ones of the imaginary cross points.

13. A heat transfer plate according to claim 12, wherein at least for a plurality of the single-cross turbulence ridges, one of the first and second turbulence flanks is connected to the support flank at the corresponding one of the imaginary cross points, and the other one of the first and second turbulence flanks is connected to the intermediate portion of the corresponding one of the support valleys.

14. A heat transfer plate according to claim 5, wherein at least a plurality of the single-cross turbulence ridges, along at least one of two end portions of their longitudinal extension, extend essentially parallel to the transverse imaginary straight lines, and wherein at least a plurality of the double-cross turbulence ridges, along two end portions of their longitudinal extension, extend essentially parallel to the transverse imaginary straight lines, the end portions being arranged on opposite sides of the center portion.

15. A heat transfer plate according to claim 1, wherein the center portion of each of the turbulence ridges comprises a first end point and a second end point arranged along a respective longitudinal center line of the center portion, wherein, for a plurality of the turbulence ridges, the first end point is displaced, in relation to the second end point, (n+0.5) x the pitch between the turbulence ridges, parallel to the longitudinal center axis of the heat transfer plate, where n is an integer.

16. A heat transfer plate comprising a first end portion, a center portion and a second end portion arranged in succession along a longitudinal center axis dividing the heat transfer plate into a first and a second half, the first and second end portions each comprising a number of port holes, the center portion comprising a heat transfer area provided with a heat transfer pattern comprising support ridges and support valleys, which support ridges and support valleys longitudinally extend parallel to the longitudinal center axis of the heat transfer plate, and which support ridges and support valleys each comprise an intermediate portion arranged between two end portions, a respective top portion of the support ridges extending in a first plane and a respective bottom portion of the support valleys extending in a second plane, which first and second planes are parallel to each other, the support ridges and support valleys being alternately arranged along a number x of separated imaginary longitudinal straight lines extending parallel to the longitudinal center axis of the heat transfer plate and along a number of separated imaginary transverse straight lines extending perpendicular to the longitudinal center axis of the heat transfer plate, the support ridges and support valleys being centered with respect to the imaginary longitudinal straight lines and extending between adjacent ones of the imaginary transverse straight lines, the heat transfer pattern further comprising turbulence ridges and turbulence valleys, a respective top portion of the turbulence ridges extending in a third plane arranged between, and parallel to, the first and second planes, and a respective bottom portion of the turbulence valleys extending in a fourth plane arranged between, and parallel to, the second and third planes, the turbulence ridges and turbulence valleys being alternately arranged, with a pitch between adjacent turbulence ridges and adjacent turbulence valleys, in interspaces between the imaginary longitudinal straight lines and connecting the support ridges and support valleys along adjacent ones of the imaginary longitudinal straight lines, at least a plurality of the turbulence ridges and turbulence valleys along at least a center portion of their longitudinal extension extend inclined in relation to the transverse imaginary straight lines, the first and third planes being spaced apart by a first straight line distance perpendicular to the first and third planes, the second and fourth planes being spaced apart by a second straight line distance perpendicular to the second and fourth planes, the first straight line distance being less than the second straight line distance.

17. A heat transfer plate comprising a first end portion, a center portion and a second end portion arranged in succession along a longitudinal center axis dividing the heat transfer plate into a first and a second half, the first and second end portions each comprising a number of port holes, the center portion comprising a heat transfer area provided with a heat transfer pattern comprising support ridges and support valleys, which support ridges and support valleys longitudinally extend parallel to the longitudinal center axis of the heat transfer plate, and which support ridges and support valleys each comprise an intermediate portion arranged between two end portions, a respective top portion of the support ridges extending in a first plane and a respective bottom portion of the support valleys extending in a second plane, which first and second planes are parallel to each other, the support ridges and support valleys being alternately arranged along a number x of separated imaginary longitudinal straight lines extending parallel to the longitudinal center axis of the heat transfer plate and along a number of separated imaginary transverse straight lines extending perpendicular to the longitudinal center axis of the heat transfer plate, the support ridges and support valleys being centered with respect to the imaginary longitudinal straight lines and extending between adjacent ones of the imaginary transverse straight lines, the heat transfer pattern further comprising turbulence ridges and turbulence valleys, a respective top portion of the turbulence ridges extending in a third plane arranged between, and parallel to, the first and second planes, and a respective bottom portion of the turbulence valleys extending in a fourth plane arranged between, and parallel to, the second and third planes, the turbulence ridges and turbulence valleys being alternately arranged, with a pitch between adjacent turbulence ridges and adjacent turbulence valleys, in interspaces between the imaginary longitudinal straight lines and connecting the support ridges and support valleys along adjacent ones of the imaginary longitudinal straight lines, at least a plurality of the turbulence ridges and turbulence valleys along at least a center portion of their longitudinal extension extend inclined in relation to the transverse imaginary straight lines, a first volume enclosed by the heat transfer plate and the first plane being smaller than a second volume enclosed by the heat transfer plate and the second plane.

* * * * *